United States Patent [19]

Knoop

[11] Patent Number: 4,634,415

[45] **Date of Patent: * Jan. 6, 1987**

[54] TAB FORMING DEVICE IN PLASTIC TAPE ROLL HOLDER

[76] Inventor: Jack P. Knoop, 326 Avenida Arboles, San Jose, Calif. 95123

[ * ] Notice: The portion of the term of this patent subsequent to May 20, 2001 has been disclaimed.

[21] Appl. No.: 767,230

[22] Filed: Aug. 19, 1985

Related U.S. Application Data

[63] Continuation-in-part of Ser. No. 538,230, Oct. 3, 1983, Pat. No. 4,540,393, which is a continuation-in-part of Ser. No. 294,533, Aug. 20, 1981, Pat. No. 4,437,854.

[51] Int. Cl.[4] ..... B26F 3/02

[52] U.S. Cl. ..... 493/353; 493/466; 267/164

[58] Field of Search ..... 493/353, 419, 466; 267/158, 164, 148, 47

[56] References Cited

U.S. PATENT DOCUMENTS

| | | | |
|---|---|---|---|
| 2,046,087 | 6/1936 | Pountnay | 267/164 |
| 2,300,423 | 11/1942 | Holben | 270/68 |
| 2,526,494 | 10/1950 | McNeil | 270/68 |
| 3,053,527 | 9/1962 | Hallam | 267/47 |
| 3,192,551 | 7/1965 | Appel | 267/158 |
| 3,204,949 | 9/1965 | Kieslich | 270/68 |
| 3,585,086 | 6/1971 | Hrusovsky | 267/47 |
| 3,602,205 | 8/1971 | Turkish | 267/158 |
| 3,810,567 | 5/1974 | Malcolm | 225/67 |
| 4,428,437 | 1/1984 | Steinberg | 172/547 |
| 4,437,854 | 3/1984 | Knoop | 493/353 |
| 4,540,393 | 9/1985 | Knoop | 493/353 |

*Primary Examiner*—Francis S. Husar
*Assistant Examiner*—William E. Terrell
*Attorney, Agent, or Firm*—Thomas Schneck

[57] ABSTRACT

A tape tab forming unit for tape roll holders wherein wear is minimized by distributing stress between a slotted cylindrical spring supporting upwardly extending struts on the one hand and a flexible forward strut on the other hand. The cylindrical spring may be formed as part of a tape roll holder or connected to such a holder. The slot in the spring defines forward and rearward spring edges from which the struts extend upwardly. The spring is strengthened by providing a thickened region between the forward and rearward edges. A tape tab is formed by combined rearward flexing of the forward strut and compression of the slotted spring.

19 Claims, 9 Drawing Figures

TAB FORMING DEVICE IN PLASTIC TAPE ROLL HOLDER

CROSS REFERENCE TO RELATED APPLICATION.

This is a continuation-in-part of application Ser. No. 538,230, filed Oct. 3, 1983, now U.S. Pat. No. 4,540,393; which is a continuation-in-part of application Ser. No. 294,533, filed Aug. 20, 1981, now U.S. Pat. No. 4,437,854.

DESCRIPTION

1. Technical Field

The invention relates to tape dispensing apparatus and in particular to tape dispensing apparatus wherein tape tabs are formed at the head of a tape section to be dispensed.

2. Background Art

In U.S. Pat. No. 2,300,423 H. Holben shows a tape roll holder having an arm actuated rocking member upon which tape normally rests. By pushing the arm downwardly, the rocking member moves back toward a tear-off station where a tape tab is formed by a loop of tape which comes together. A stop screw below the arm is adjusted to vary the space and the resulting tab length.

In U.S. Pat. No. 2,526,494 to G. McNeil a spring arm within a tape roll holder moves back and forth for the purpose of forming tape tabs.

In U.S. Pat. No. 3,204,949 H. Kieslich discloses a cam actuated set of rollers which form tape tabs in a tape dispenser.

In German specification No. 2,232,663, Malcolm describes a spring loaded cutter which is pulled away from the tape bearing surface and then released to form tabs with the tape.

These and other patents illustrate the utility of tape tabs associated with tape roll holders. Many of the prior art devices obtain the bias action of the tab-forming member by metal springs or mechanical arrangement which preclude the use of molded tape tab-forming devices. A molded tab-forming device made from a low-cost non-engineering plastic, such as polystyrene, subjected to uneven or large stresses caused by bending or flexing, will experience material fatigue.

An object of the invention was to devise tab-forming devices which are characterized by long life and simplified low-cost construction, not available other than by molding.

Another object was to devise molded plastic tab-forming devices which could, with minimal variation from existing tape dispenser designs, be either easily attached to those tape dispensers, or using the same material, be an integral part of the tape dispenser housing.

DISCLOSURE OF INVENTION

The above objects have been met by a longer lasting molded polymer tape tab forming device which, in one embodiment, can be constructed as a unitary member from plastics and attached to existing plastic tape dispensers or dispensers of similar construction. Long life is achieved by incorporating means for distributing the stresses and bending forces experienced by the device in a more uniform manner. The tab-forming device is characterized by a pair of upwardly extending forward and rearward struts having upper extremities terminating in wings. The lower extremities of the struts are hinged by a hollow cylindrical molded flexible spring, i.e. an annular spring, which limits the outward spreading of the upper extremities of the struts. The cylindrical spring's thickness changes gradually from thick in the center section where the stresses are normally highest, to thinner on both ends. The wings on the struts provide support tables in the tape dispensing path so that a section of tape may be supported in two places and brought together to form a tab by self-adherence of the tape near the wings. This requires that the struts be pushed together to a closed position bringing the wings into a wing-to-wing abutting relation. When the cylindrical spring is stressed and bending takes place, it starts first at the thinner ends, rather than bending solely in the center section of the spring, thus distributing the stresses more evenly over the entire spring.

Additional distribution of stress may be provided by a flexible forward strut. As the struts are pushed together, the ends of the cylindrical spring contract while the struts are still in a spaced, partially open position. Continued movement of the struts from the partially open position to the closed position flexes the forward strut. Thus some of the stress usually experienced by the spring is distributed to the strut. An arm may extend downwardly from the forward strut for pushing the strut.

The cylindrical spring may incorporate means for obtaining tabs of varying length. A pawl may be provided on the inside wall of the cylinder to engage one of at least two pawl seats in an inserted ratchet spool by which means the diameter of the cylinder may be increased resulting in an outward spreading of the struts. By changing the pawl position in the ratchet spool, thereby obtaining a wider or narrower open position of the struts, two or more sizes of tabs may be formed.

The tape tab-forming device of the present invention may be incorporated in existing roll holders since it is easily connected to a tape tear-off station. It may also be molded as a unit with the roll holder, or made in halves. The durable cylindrical spring and the flexible forward strut minimize fatigue on a molded unit, enabling use of common plastics.

The invention is incorporated into two classes of tab-forming devices. One class has preset tab lengths. The other class has variable tab lengths.

BEST MODE FOR CARRYING OUT THE INVENTION

Figure 1:
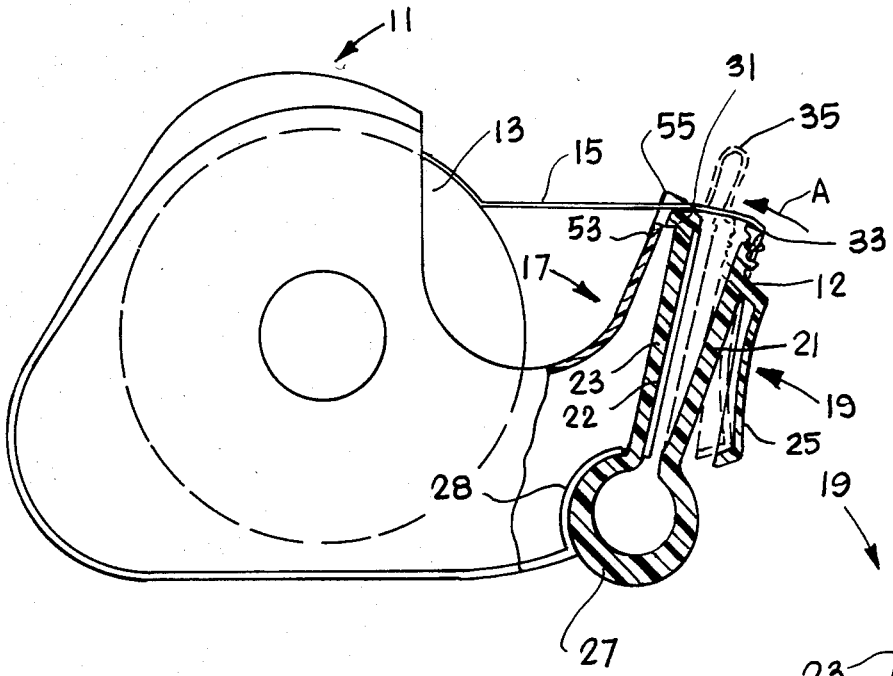
FIG. 1 is a partial cutaway view of a tape dispenser with the tape tab forming device of the present invention connected thereto.

With reference to FIG. 1, a tape dispenser may be seen with two major assemblies. A first major assembly is the roll holder 11 which supports the tape roll 13. This roll contains pressure sensitive tape with an adhesive backing on one side. A terminal span 15 of the tape is guided in a tape path toward an upwardly extending tape support and tear-off station 17. This type of roll holder and tear-off station are known in the prior art and are especially popular because of low cost and convenience. Such a roll holder is similar to one manufactured by Minnesota Mining and Manufacturing Co. While the present invention is shown for use with such a roll holder it is not restricted to such use and may be used with other roll holders.

Figure 3:
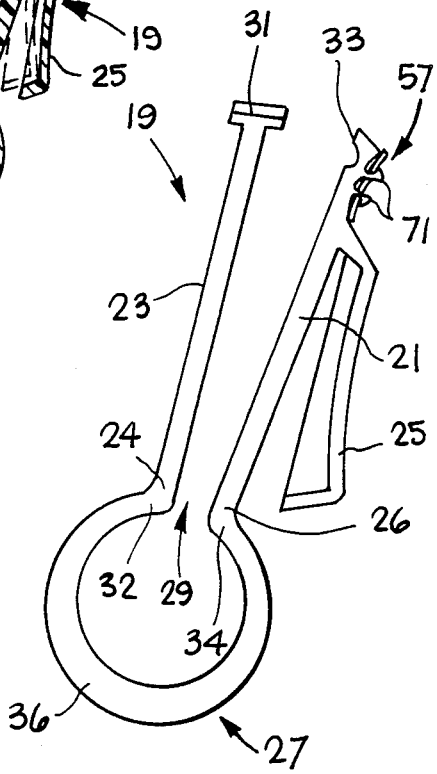
FIG. 3 is a side plan view of the tape tab forming device of FIG. 1.
Figure 2:
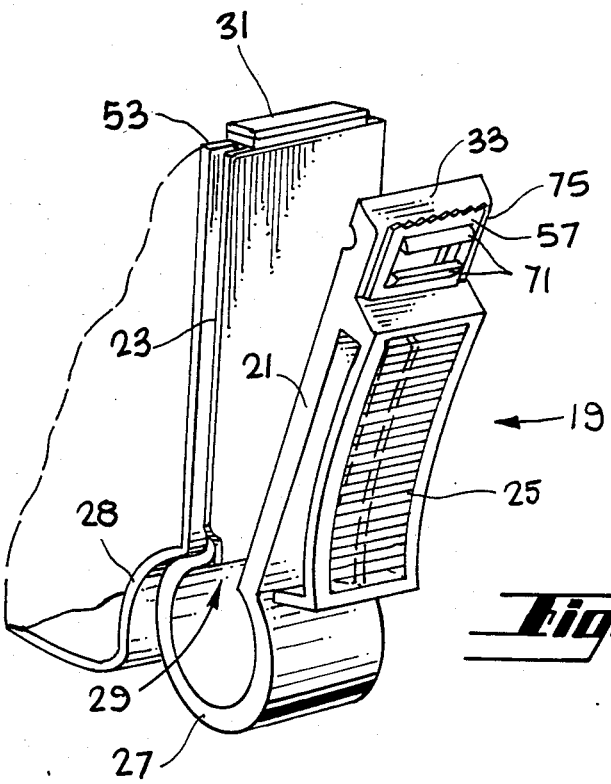
FIG. 2 is a perspective front view of the tape tab forming device of FIG. 1.

The second major assembly of the present invention, which may be viewed in FIGS. 1, 2 and 3, is the tape tab forming device 19 which is connected to the upwardly extending tape support station 17. The tab forming device 19 is of essentially unitary construction, although a metal tape cutter with a serrated metal tear-off edge may be added, as explained below. The principal members of the tape forming device 19 are the upwardly extending forward strut 21 and rearward strut 23. The lower extremities of these struts are hinged by means of cylindrical molded flexible spring 27. The upper extremities of the struts terminate in wings 31 and 33 which are used to support tape portions in order to form the tape tab 35. Forward strut 21 is flexible, capable of bending slightly toward strut 23 in the direction of arrow A. To assist this motion, a downwardly depending arm 25 is supported from near the top of strut 21. The intended purpose of arm 25 is to provide a finger grip for tape tab formation. Such a grip transfers force to the top of strut 21, causing flexing of the strut toward strut 23 and compressive tension on flexible spring 27.

This type of roll holder 11 has an anchor member 53 and a front wall 22 of upwardly extending station 17 provided for the purpose of retaining a metal hook with a serrated edge for tearing tape. In the prior art, this hook passed over the apex 55 of tape support station 17. However, in the present invention, the tape cutter is mounted in front of wing 33 forming the most forward portion of the tape tab forming assembly. Apex 55 is to needed as a tape support region and could be eliminated. The upper portion of strut 23 terminates in an upwardly inclined wing 31. Rearward strut 23 is inserted behind the front wall 22 of station 17 for retention by anchor member 53 and the upper extremity of front wall 22. Wing 31 is supported on opposite sides by anchor member 53 and front wall 22 for attachment of the tape tab forming device to the tape dispenser.

The lower extremities 24 and 26 of rearward and forward struts 23 and 21 are hinged by means of cylindrical molded flexible spring 27. A curved recess 28 in the bottom of station 19 accommodates spring 27. In FIGS. 2 and 3 cylindrical spring 27 contains a lengthwise open slot 29. To the front edge 34 of spring 27 is joined the bottom 26 of forward strut 21. To the back edge 32 of spring 27 is joined the bottom 24 of strut 23. Cylindrical spring 27 maintains the upper extremity of strut 21 in a spaced-apart open position from rearward strut 23.

The thickness of cylindrical spring 27 is not uniform but rather increases in thickness from both edges 32 and 34 toward a thickest center section 36 of spring 27. This change in thickness may be produced by making the inner and outer cylindrical surfaces of spring 27 nonconcentric, i.e. with offset axes. Typically, cylindrical spring 27 has a 20 millimeter diameter, a relaxed slot 29 larger than 1.2 millimeters, and an average thickness of about 3 millimeters. The thickness difference between the thickest center section 36 to either edge 32 or 34 is typically about 0.5 millimeter.

Operation of the tape tab-forming device is indicated in FIG. 1 by dashed lines 12 which indicate the closed position of struts 21 and 23. In operation, strut 21 flexes backwards using arm 25 in a direction indicated by arrow A to the position indicated by the dashed lines 12 until a tape tab 35 is formed by bringing wings 31 and 33 into a wing-to-wing abutting relation or approaching such a relation. This tab may then be grasped by a user and the tape pulled forward and torn off at a desired length. When the struts 21 and 23 are closed, the cylinder 27 is stressed. With cylindrical springs of uniform thickness the stresses and bending would be located primarily in the center section 36 causing fatigue in nonengineering plastics, such as polystyrene. When cylinder 27 is stressed, bending starts first at the thinner edges 32 and 34 and is then distributed uniformly over the entire cylindrical spring 27, thus avoiding fatigue in polystyrene springs.

The upper region of the strut 21 may be seen in FIGS. 2 and 3 to have a tape cutter 57. Tape cutter 57 is a generally flat rectangular piece of metal with a slot therein. A pair of tangs 71 project outwardly from the forward side of strut 21 for holding cutter 57. Tape cutter 57 is mounted so that the tangs accommodate the slot when the cutter is forced over them. The tangs then resume their original position to lock the cutter securely into place. Cutter 57 has a forward serrated edge 75 for tearing tape.

Figure 4:
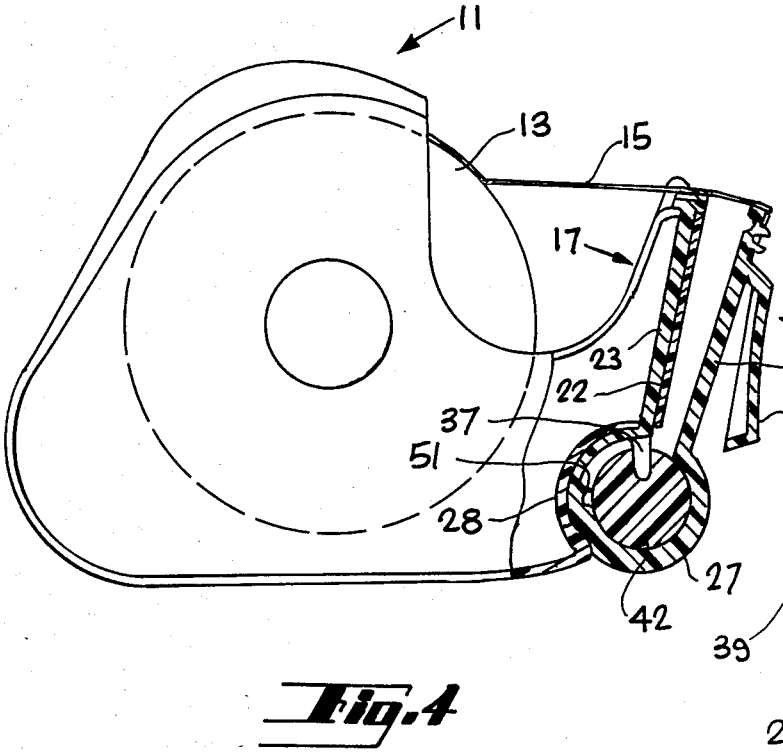
FIG. 4 is a partial cutaway view of a tape dispenser with the variable length tape tab forming device of the present invention connected thereto, including a ratchet spool.
Figure 6:
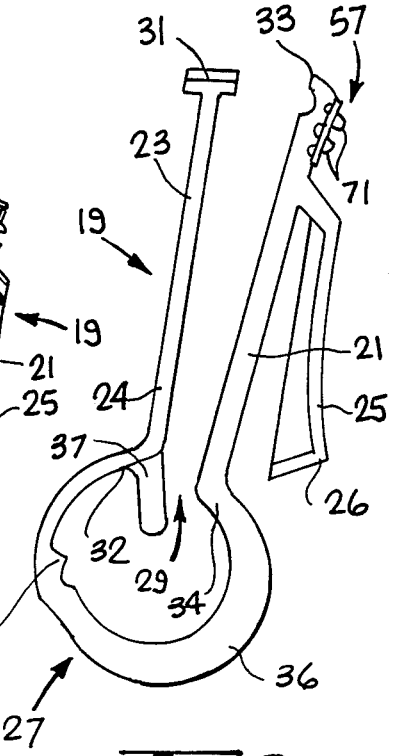
FIG. 6 is a side plan view of the device of FIG. 4 without the ratchet spool.
Figure 5:
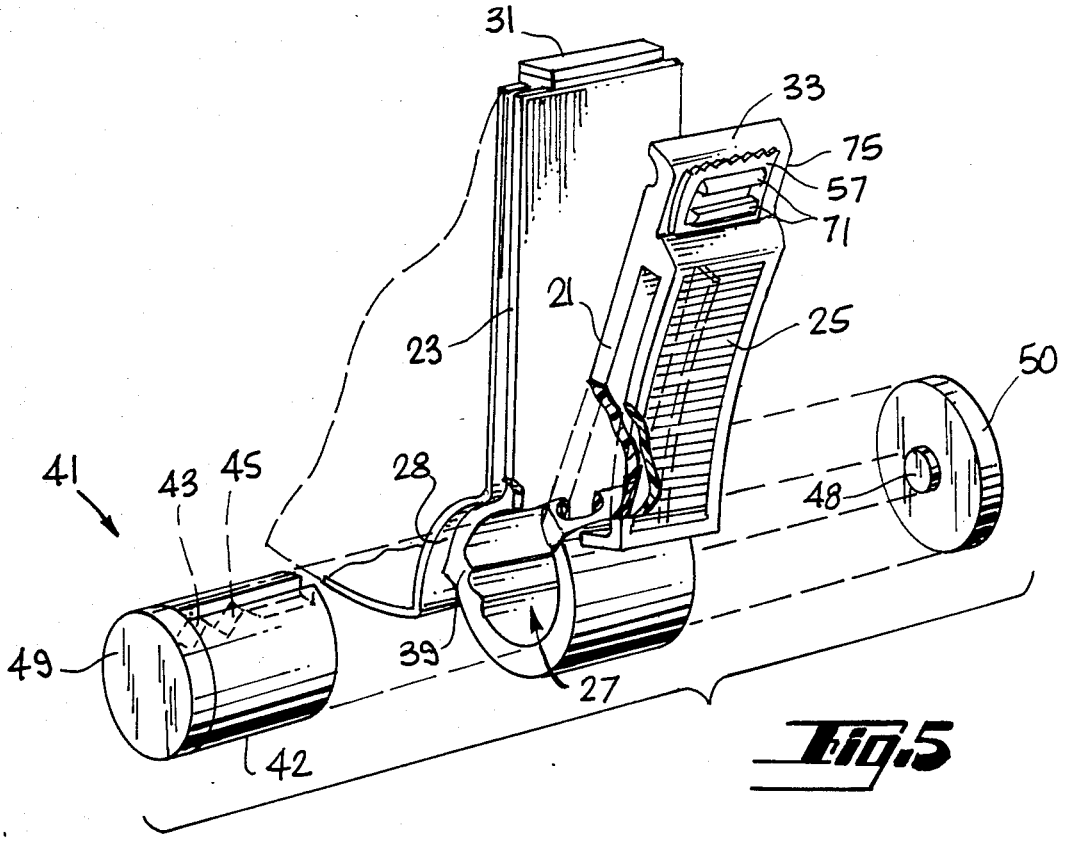
FIG. 5 is an exploded perspective view of the tape tab forming device of FIG. 4.

In FIGS. 4–6, a dispenser 11 and tape tab forming device 19, similar to the dispenser and device in FIGS. 1–3, incorporates a means for obtaining variable tab lengths. A roller holder 11 supports a tape roll 13 containing adhesive tape. A terminal span 15 of the tape is guided in a tape path toward an upwardly extending tape support station 17. Tape tab forming device 19 is connected to the station 17 behind a front wall 22 of station 17. Tape tab forming device 19 comprises an upwardly extending flexible forward strut 21 and a rearward strut 23, both hinged at their lower extremities to a flexible cylindrical spring 27. Struts 21 and 23 terminate at their upper extremities in wings 31 and 33 for supporting tape portions in order to form tape tabs like those in FIG. 1. A downwardly depending arm 25 causes flexing of strut 21 toward strut 23 and provides a finger grip. A tape cutter 57 is attached to the front of strut 21 by means of tang 71.

The tape tab forming device shown in FIGS. 5 and 6 may be used to form tabs of two or more different lengths. As before, the thickness of cylindrical spring 27 is not uniform but rather increases in thickness from both edges 32 and 34 toward a thickest center section 36 of spring 27. When the cylinder is stressed and bending takes place, it starts first at both ends, distributing the stresses and bending more evenly over the cylinder wall. However, as explained below with reference to FIGS. 7 and 8, when making the longest tab a larger amount of bending takes place. So for variable length tab formers, acetal plastic is preferred. The nonuniform thickness of cylindrical spring 27 provides for smoother operation.

Extending down from the edge of the rear of slot 29 is pawl 37. A guide bar 39 runs the length of the cylindrical spring. Guide bar and pawl are between 60 and 75 degrees apart. Ratchet spool 41 has a cylindrical body 42 containing at least two pawl seats 43 and 45 as shown in FIG. 5. The pawl seats are in a step configuration of increasing depth. The embodiment shown uses two pawl seats; however, more seats of different depths could be cut into the ratchet spool to provide for more than two tab lengths. The cylindrical body 42 of ratchet spool 41 is of a diameter to fit inside cylindrical spring 27. Ratchet spool 41 contains a smaller diameter pushbutton 49 and a larger diameter pushbutton 50 at front and back. The two pushbuttons are of larger diameters than the spring, thereby preventing the spool from sliding out of the cylindrical spring. As shown in FIG. 4, a half-rounded guide slot 51 runs longitudinally on body 42 for locking on to guide bar 39 on the spring. A small button 48, shown in FIG. 5 in the center of pushbutton 50 fits into a hole on the end of body 42 for locking the body into the spring.

Figure 8:
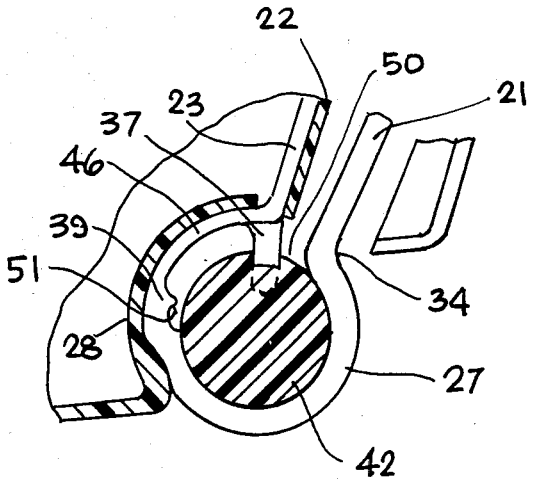
FIG. 8 is a cross section view taken along the line 8—8 of FIG. 7.
Figure 7:
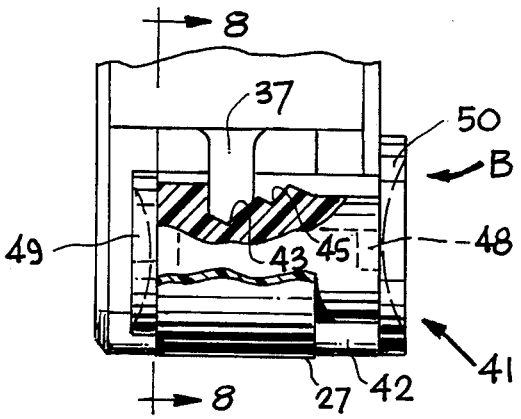
FIG. 7 is a partial cutaway view of the ratchet spool and spring hinge of the tape tab forming device of FIG. 4.

The tab-forming device is molded of a polymer so that the two struts are normally biased in an open position. The tab is formed when the two struts are pushed together in an abutting relation. The nature of the plastic material used forces the struts to return to their normal open position when the pressure is removed from strut 21. By means of the ratchet spool 41 this normal spaced apart position can be slightly expanded as shown in FIGS. 7 and 8. By pushing ratchet spool 41 so that pawl 37 is seated in the deepest pawl seat 43 the normal diameter of spring 27 is retained as in FIG. 7 and FIG. 8.

As shown in FIG. 8, guide bar 39 and guide slot 51 are of complementary half-rounded shape. The half rounding of both guide bar and the slit accommodates the slight movement that takes place when the pawl is moved from one position to the other. The guide bar prevents twisting of the ratchet spool in the spring.

Positioning of the pawl into pawl seat 45 by pushing the ratchet spool in the direction of arrow B deforms the area of the spring between the pawl and guide bar 39, pushing the spring at point 46, further away from the spool body, in effect increasing the diameter of the cylindrical spring and expanding the art between the two struts 21 and 23. The pressure of the pawl against the pawl seat also pushes the spool against the guide bar, thereby pushing the spring outward at that point, increasing the diameter of the spring in the area between the guide bar 39 and point 54 where front strut 21 joins the spring, further increasing the arc between struts 21 and 23. This forced opening of the diameter of the cylindrical spring can result in different tab lengths of, for example, from 8 to 12 millimeters. Springs which have larger pawls and deeper pawl seats may be used to obtain tabs of larger sizes.

The pawl seats have ratchet angles of 45 degrees and 15 degrees corresponding to risers and treads in the step-wise configuration of the pawl seats. The bottom of the pawl has an angle of approximately 15 degrees with a matching 15 degrees in the bottom or tread of the seat which yields secure seating. The front end or rise of the pawl seat and the front of the pawl have matching 45 degree angles which make movement from one position to another easier.

By placement of the large pushbutton 50 on the end of the ratchet spool facing the 45 degree angle on the pawl and the smaller pushbutton end 49 on the end of the ratchet spool facing a 15 degree angle inclination of the pawl, indication is given that pushing from the large pushbutton side will increase the diameter of the cylindrical spring and thereby the tab length. Pushing from the small diameter pushbutton 49 will correspondingly decrease the diameter of the spring resulting in smaller tab lengths.

The force needed to move pawl 37 from one pawl seat to another is small and distinct from the force needed to close the struts 21 and 23. The bottom of station 17 has a curved recess 28 which accommodates spring 27. The thinner end section 46 stretches a little when pawl 37 moves from seat 43 to seat 45. Guide bar 39, then, acts to push cylinder 27 against recess 28 and stabilize cylinder 27 into place.

Figure 9:
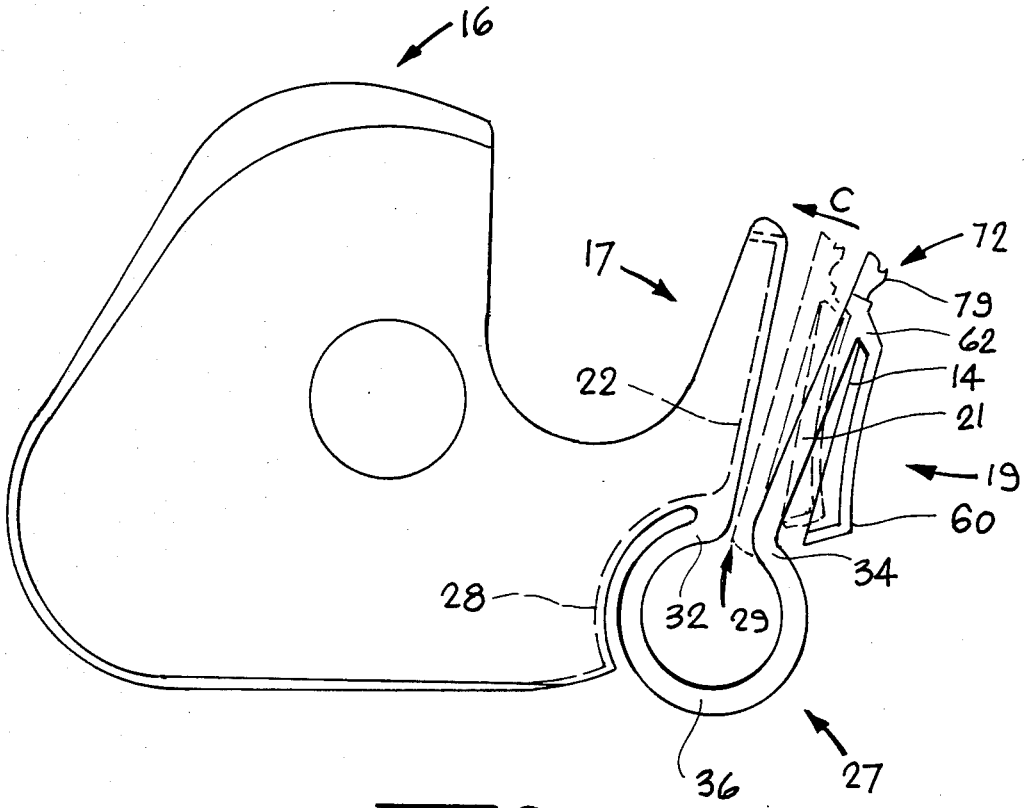
FIG. 9 is a side plan view of a tape dispenser with the tape tab forming device of the present invention molded as a unit.

With reference to FIG. 9, an embodiment of a tape dispenser having an integral tape tab-forming device may be seen with two major components. The first major component is the roll holder 16 which supports a tape roll 13. This roll contains pressure sensitive tape with an adhesive backing on one side. The terminal span 15 of the tape is guided in a tape path toward the upwardly extending tape support station 17.

The second major component is the tape tab-forming device 19 which is connected to the upwardly extending station 17. Two members of the tape forming device 19 are the upwardly extending flexible forward strut 21 and the front wall 22 of station 17 of the roll holder. The lower extremities of strut 21 and station 17 are hinged by means of cylindrical molded flexible spring 27. Spring 27 has a lateral slot with front and back edges 32 and 34. The upper extremity of strut 21 terminates in wing 33 which in combination with wing 31 on station 17 is used to support tape portions in order to form tape tabs.

Strut 21 is flexible. A downwardly depending arm 60 connects to strut 21 at a point 62 for pushing strut 21 from a normally open position and a closed position where strut 21 abuts with station 17. In operation, strut 21 is pushed backwards in a direction indicated by arrow C from the open position to a spaced partially open position indicated by the dashed lines 14. In the partially open position, ends 32 and 34 of spring 27 are contacting so that spring 27 can bend no further, but strut 21 is still spaced from station 17. Pushing strut 21 further, between the partially open position and the closed position, causes strut 21 to flex. Thus, the stress is distributed between spring 27 and strut 21. Spring 27 may have either nonuniform or uniform thickness when strut 21 is flexible. The dispenser and tab forming device in FIG. 9 also has a molded polymer tear-off section 78 on the upper extremity of strut 21. A forward serrated edge 79 is provided on tear-off section 78 for tearing tape.

In each of the embodiments shown in FIGS. 1–8, the body of the tape tab former is made from a polymer material that should have sufficient rigidity to provide a spring-like quality, resistance to flexing fatigue and low tendency to stress cracking. The class of polymeric materials known as acetal are well suited for purposes of the present invention. Acetal plastic has the ability to return to its molded shape after stretching, such as when the struts are brought together, thereby stretching the cylinder spring. Within the general class of acetal the following materials are particularly suitable: Delrin, manufactured by DuPont Chemicals and Celcon, manufactured by Celanese Chemicals. This type of plastic has a memory that forces the moving parts to contract to the smallest setting. Memory is built in when the parts are molded with this smallest configuration. Another class of polymeric materials known as polystyrene, formerly unsuitable due to fatigue and cracking, may also be used with the tape tab formers of the present invention. This class of low-cost nonengineering plastic material does not fatigue when stresses are distributed uniformly over the entire spring, or over both the spring and the forward strut.

Although the three embodiments shown are preferred, other embodiments combining features in the different preferred embodiments are possible, and the invention is not restricted solely to the three embodiments shown. For example, the molded polymer tear-off section 78 in FIG. 9 may be used in the tab forming devices of FIGS. 1–6. The tape cutter 57 shown in FIGS. 1–6 and held by tangs 71 may be used in the dispenser and tab former in FIG. 9. The flexible strut of FIG. 9 may be incorporated into tab formers in FIGS. 1–6, just as the nonuniformly thick spring 27 may be incorporated into the embodiment in Fig.9. Any of the embodiments may have tab formers 19 separate from and connected to the dispenser 11 or molded in a unitary construction with dispener 16 in FIG. 9.

I claim:

1. A tape tab device in a tape dispenser comprising, at least one upright flexible strut with upper and lower extremities, the upper extremity terminating in a wing having a forward tape tear-off section, and a flexible, cylindrical spring having a lateral slot with front and back edges, the front edge supporting said upright flexible strut, said cylindrical spring increasing in thickness from said front and back edges to a thickest center section, said cylindrical spring supported at said back edge by a tape roll holder, said tape roll holder having a tape support region at approximately the same elevation as said wing of the upright strut, said spring having a relaxed position biasing said wing in a spaced apart relation relative to said tape support region, said spring having a tensed position with combined rearward flexing of the strut and compression of said spring said wing being near said tape support region in said tensed position, said spring being movable between said relaxed position and said tensed position thereby defining means for forming a tape tab from tape suppliable by said tape roll holder.

2. The device of claim 1 wherein said strut, spring and tape roll holder means comprise a unitary member.

3. In combination, a dispenser of adhesive tape and a device for forming a tab in the tape, comprising, roll holder means for supporting a roll of tape, said roll holder means having a forward upwardly extending tape support station with upper and lower extremities, a forward upwardly extending flexible strut with upper and lower extremities, the upper extremities of the station and the strut each terminating in a wing, the wing of the strut having a forward extending tear-off section, and a flexible spring comprising a cylinder having a lateral slot with front and back edges, said cylinder increasing in thickness from said front and back edges to a thickest center section, said lower extremity of the strut and the station joined respectively to said front and back edges of said slot, said strut being biased by said spring to diverge upwardly from the upper extremity of the station, thereby defining a spaced open position, said strut and said spring being relaxed in said open position, the wing of the strut abutting the wing of the station when said strut is pushed against said station, thereby defining a closed position, said strut being rearwardly flexed and said spring being compressed in said closed position, said strut being movable between open and closed positions, thereby defining means for forming tape tabs at said wings from tape suppliable by said roll holder means by movement of said strut between open and closed positions.

4. The combination of claim 3 wherein the upper extremity of the strut has two integral tangs on a forward side thereof, and further comprising a flat tape cutter with a slot therein, said tangs accommodating the slot to detachably engage the cutter, said cutter having a serrated forward end to provide a tape cutting edge.

5. The combination of claim 3 wherein the wing of the strut is covered by a tear-off section having a forward serrated edge for tearing tape.

6. The device of claim 3 wherein said cylinder has a pawl extending parallel to and toward the center axis of said cylinder from said back edge of said slot, and further comprising a ratchet spool insertable in said cylinder, having a circular solid wall with open, circular ends and having pawl seats of increasing depth insaid wall parallel to said slot for insertion of said pawl, whereby the diameter of said cylinder is altered.

7. The combination of claim 3 wherein said roll holder means, strut, wings and spring comprise a unitary member, molded of polystyrene plastic.

8. The combination of claim 3 wherein said strut is flexible, said front and back edges of said slot being pushed into contact with each other by said movement of the strut between open and closed positions, said front edge contacting said back edge when said upper extremities of said strut and said station are in a spaced partially open position, said strut being flexed by movement thereof between said partially open and closed positions.

9. The combination of claim 3 further comprising a downwardly depending arm joined to said strut near said upper extremity of the strut.

10. A molded polymer tab-forming device for attachment to a tape dispenser comprising, a pair of upwardly extending forward and rearward struts, having lower and upper extremities, the upper extremities of the struts each terminating in a wing, the wing of the forward strut having a forward extending tear-off section, anchor means being disposed on said rearward strut for rapid coupling to a tape dispenser, and a flexible spring comprising a cylinder having a lateral slot with front and back edges, said lower extremities of the forward and rearward struts joined respectively to said front and back edges of said slot, said struts being biased by said spring to diverge upwardly at the upper extremities thereby defining a spaced open position, said strut and said spring being relaxed in said open position, the two wings of said struts abutting when said forward strut is pushed against rearward strut, thereby defining a closed position, said wing defining means for forming tape tabs by movement of the struts between said open and closed positions, said forward strut being flexible, said front and back edges of said slot being pushed into contact with each other by said movement of the struts between said open and closed positions, said front edge contacting said back edge when said forward and rearward struts are in a spaced partially open position, said forward strut being in a flexed condition between said partially open and closed positions.

11. The device of claim 10 wherein said cylinder increases in thickness from said front and back edges to a thickest central section.

12. A molded polymer tab-forming device for attachment to a tape dispenser comprising, a pair of upwardly extending flexible forward and reareward struts, having lower and upper extremities, the upper extremities of the struts each terminating in a wing, the wing of the forward strut having a forward extending tear-off section, anchor means being disposed on said rearward strut for rapid coupling to a tape dispenser, and a flexible, cylindrical spring having a lateral slot with front and back edges, said cylindrical spring increasing in thickness from said front and back edges to a thickest center section, said lower extremities of the forward and rearward struts joined respectively to said front and back edges of said slot, said struts being biased by said spring to diverge upwardly at the upper extremities thereby defining a spaced open position, said forward strut and said spring being relaxed in said open position, the two wings of said struts abutting when said forward strut is pushed against said rearward strut, thereby defining a closed position, said forward strut being flexed and said spring compressed in said closed position, said wings defining means for forming tape tabs from tape suppliable by said tape dispenser by movement of the struts between open and closed positions.

13. The device of claim 11 wherein the upper extremity of the forward strut has two integral tangs on a forward side thereof, and further comprising a flat tape cutter with a slot therein, said tangs accommodating the slot to detachably engage the cutter, said cutter having a serrated forward end to provide a tape cutting edge.

14. The device of claim 11 wherein the forward wing is covered by a tear-off section molded of a hard polymer having a forward serrated edge for tearing tape.

15. The device of claim 11 wherein said cylinder has a pawl extending parallel to and toward the center axis of said cylinder from said back edge of said slot, and further comprising a ratchet spool insertable in said cylinder, having a circular solid wall with open, circular ends and having pawl seats of increasing depth in said wall parallel to said slot for insertion of said pawl, whereby the diameter of said cylinder is altered.

16. The device of claim 11 wherein said rearward strut extends into the interior of said tape dispenser and detachably engages said tape dispenser with said anchor means.

17. The device of claim 11 wherein said struts, wings and spring comprise a unitary member molded of polystyrene plastic.

18. The device of claim 11 wherein said forward strut is flexible, said front and back edges of said slot being pushed into contact with each other by said movement of the struts between open and closed positions, said front edge contacting said back edge when said forward and rearward struts are in a spaced partially open position, said forward strut being flexed by movement of the struts between said partially open and closed positions.

19. The device of claim 12 further comprising a downwardly depending arm joined to said forward strut near said upper extremity of said forward strut.

* * * * *